US005160582A

United States Patent [19]

Takahashi

[11] Patent Number: 5,160,582

[45] Date of Patent: Nov. 3, 1992

[54] CELLULOSE-BASED, INFLAMMABLE, BULKY PROCESSED SHEETS AND METHOD FOR MAKING SUCH SHEETS

[75] Inventor: Ryoji Takahashi, Tokyo, Japan

[73] Assignee: Chisso Corporation, Osaka, Japan

[21] Appl. No.: 520,380

[22] Filed: May 8, 1990

[30] Foreign Application Priority Data

| | | | |
|---|---|---|---|
| Jun. 7, 1989 | [JP] | Japan | 1-144969 |
| Jun. 8, 1989 | [JP] | Japan | 1-145774 |
| Jun. 8, 1989 | [JP] | Japan | 1-145775 |
| Jun. 9, 1989 | [JP] | Japan | 1-147662 |

[51] Int. Cl.[5] ..... D21H 11/20

[52] U.S. Cl. ..... 162/117; 162/146; 162/157.1; 162/157.6; 162/206

[58] Field of Search ..... 162/9, 157.6, 146, 111, 162/157.1, 206, 109, 117

[56] References Cited

U.S. PATENT DOCUMENTS

| | | | |
|---|---|---|---|
| 3,028,296 | 4/1962 | Adams et al. | 162/146 |
| 3,114,670 | 12/1963 | Iwasaki | 162/146 |
| 3,674,621 | 7/1972 | Miyamoto et al. | 162/146 |
| 4,204,054 | 5/1980 | Lesas et al. | 162/146 |
| 5,019,211 | 5/1991 | Sauer | 162/111 |

FOREIGN PATENT DOCUMENTS

| | | | |
|---|---|---|---|
| 2615889 | 10/1977 | Fed. Rep. of Germany | 162/146 |
| 42-12286 | 7/1967 | Japan | 162/146 |
| 48-1443 | 1/1973 | Japan | 162/111 |

*Primary Examiner*—Peter Chin
*Attorney, Agent, or Firm*—Fred Philpitt

[57] ABSTRACT

Bulky processed sheets which are obtained from mixtures of crosslinked pulp and hot water-soluble fibers, or crosslinked pulp, thermally fusible fibers and binders are described. The sheets may be embossed by hot pressing them in wet state and may be treated with flame retardants. The bulky sheets which may be embossed or treated with retardants have wide utility in various fields and especially as interior materials.

18 Claims, No Drawings

CELLULOSE-BASED, INFLAMMABLE, BULKY PROCESSED SHEETS AND METHOD FOR MAKING SUCH SHEETS

BACKGROUND OF THE INVENTION

1. Field of the Invention

This invention relates to cellulose-based, bulky mats and sheets having good decorative and functioning capabilities which can be molded or shaped for use as building materials such as wall and ceiling materials, vehicles, furniture, decorative articles, filter media, absorption media and the like. The invention also relates to embossed mats and sheets of cellulose-based material and to methods for making such mats and sheets as mentioned above.

2. Prior Art

Known bulky mats and sheets mainly composed of pulp include, for example, non-woven fabrics which are obtained by a dry process wherein fibrillated pulp fibers are bonded together by means of a binder, those non-woven fabrics to which long fibers such as rayon are applied onto one or both surfaces thereof, or sheets obtained by mixing thermally fusible fibers or powder with pulp fibers and thermally bonding the fibers together.

These mats or sheets are bulky but since pulp fibers are used as they are, the bulkiness will be lost when they are in contact with water, with the degree of restoration of the bulkiness being small after re-drying of the once water contacted mats or sheets.

Although there is known a sheet for use as a wall paper which is produced by subjecting a vinyl chloride resin compound containing a foaming agent to foaming by heating and embossing, a cellulose-based embossed sheet has never been known. When these vinyl chloride resin-based sheets having no moisture absorption characteristics are used as a building material, they have no function of controlling humidity and are moisture condensing in nature with an attendant problem of safety at the time of firing in that they emit a very great amount of smoke when burnt and generate a large amount of halogen compound gases.

There is known a technique of making bulky pulp fibers by reaction of the fibers with crosslinking agents. However, this technique has no practical utility because if bulky pulp fibers are made in such a way as mentioned above, fibrillation of the crosslinked fibers results in formation of short fibers and the strength is considerably lowered owing to the reduction in number of the hydroxyl groups by consumption during the crosslinking reaction.

SUMMARY OF THE INVENTION

An object of the invention is to provide bulky mats or sheets capable of undergoing embossing and having good dimensional stability which have good moisture absorption characteristics without a loss of bulkiness on contact with water and which have satisfactory strength and also provide highly decorative embossed mats or sheets.

Another object of the invention is to provide cellulose-based, inflammable, bulky processed sheets which are suitable for use as building interior materials, such as wall and ceiling materials and, particularly, a wall material, which necessitate inflammability and safety.

Widely employed interior materials such as wall paper and the like which have a decorative effect and processability are those which are fabricated by subjecting vinyl chloride resin compounds to which plasticizers, flame retardants, foaming agents and the like are added, to foaming by heating and embossing. These interior materials are made of vinyl chloride resin and have thus no moisture absorption characteristics. Especially, when used as a wall material, they do not have any function of controlling moisture but have the capability of moisture condensation. In closed rooms, there is a great tendency toward the growth of mold or decay and change in the quality of the inside wood portion.

If the building using such an interior material is on fire, there arises the problem that smoke is emitted in very large amounts along with a large amount of gases of halogen compounds. On the other hand, some cellulose processed paper has been used as a wall paper but has little bulkiness, making it difficult to make a complicated steric pattern.

A further object of the invention is to provide cellulose-based inflammable, bulky processed sheets or mats which have good inflammability, good moisture retention or good function of controlling moisture and high strength and which are high in safety with respect to the emission of smoke and the generation of gases when burnt along with capabilities of printing and embossing whereby they are optimumly usable as building materials and particularly, a wall paper, which are adapted for highly steric and decorative purposes and have good functioning properties.

The above objects can be achieved, according to the invention, by the following sheets and methods (1) to (15).

(1) A bulky processed sheet which is obtained by mixing a crosslinked pulp and hot water-soluble fibers and making a sheet from the mixture.

(2) A bulky processed sheet as recited in (1) wherein the sheet is subjected to embossing under heating conditions in a wet state.

(3) A bulky processed sheet which is obtained by mixing a crosslinked pulp, thermally fusible fibers and a binder therefor and making a sheet from the mixture.

(4) A bulky processed sheet as recited in (3) wherein hot water-soluble fibers are used as the binder.

(5) A bulky processed sheet as recited in (3) wherein the thermally fusible fibers are thermally fusible composite fibers obtained by subjecting two or more thermoplastic polymers having different melting points to composite melt spinning.

(6) A method for fabricating a bulky processed sheet characterized by comprising making a sheet from a mixture of a crosslinked pulp, thermally fusible fibers and a binder, subjecting the sheet in wet state to hot pressing treatment, drying the hot pressed sheet, and embossing the dried sheet under heating conditions.

(7) A method as recited in (6), wherein the embossing is effected at a temperature lower than the softening point of a high melting polymer used as the thermally fusible fibers.

(8) A cellulose-based, inflammable, bulky processed sheet which is obtained by mixing a crosslinked pulp and hot water-soluble fibers, making a sheet from the mixture, and treating the sheet with a flame retardant.

(9) The bulky processed sheet as recited in (8), wherein the sheet in wet state is embossed under heating conditions.

(10) The bulky processed sheet as recited in (8), wherein the crosslinked pulp is obtained by crosslinking cellulose with a crosslinking agent which has two or more crosslinkable functional groups capable of reaction with cellulose and has also a cyclic structural moiety provided between the two or more crosslinkable functional groups in the molecule.

(11) A cellulose-based, inflammable, bulky processed sheet which is obtained by mixing a crosslinked pulp, thermally fusible fibers and a binder, making a sheet from the mixture, and treating the sheet with a flame retardant.

(12) The bulky processed sheet as recited in (11), wherein hot water-soluble fibers are used as the binder.

(13) The bulky processed sheet as recited in (11), wherein the thermally fusible fibers are composite fibers of two or more thermoplastic polymers having different melting points.

(14) A method for fabricating a bulky processed sheet characterized by comprising mixing a crosslinked pulp, thermally fusible fibers and a binder, making a sheet from the mixture, subjecting the sheet in wet state to hot pressing treatment, drying the hot pressed sheet, and embossing the dried sheet under heating conditions.

(15) A method as recited in (14), wherein the embossing is effected at a temperature lower than the softening point of a high melting polymer for the thermally fusible fibers.

The crosslinked pulp used in the present invention is, as described hereinafter, one which is obtained by reaction between pulp and a crosslinking agent. The hot water-soluble fibers are those fibers containing a polymer having adhesion to pulp.

DETAILED DESCRIPTION AND EMBODIMENTS OF THE INVENTION

The crosslinked pulp used in the present invention has such a crosslinked structure that a crosslinking agent is reacted with the hydroxyl groups of cellulose, and has thus a lower degree of bond between cellulose fibers owing to the hydrogen bond than ordinary pulp, with a considerable lowering of the strength as compared with the pulp which has not been crosslinked. In the practice of the invention, hot water-soluble fibers are mixed with the pulp, which is subsequently hot pressed in wet condition, so that the hot water-soluble fibers serve as an adhesive for the pulp, thereby obtaining a sheet having very high strength.

The embossing technique includes a one-stage procedure of producing a bulky sheet and a two-stage procedure wherein after production of a bulky sheet, it is embossed in wet state. Either procedure may be used in the practice of the invention.

The hot water-soluble fibers used in the afore-stated embodiments (1) and (2) of the invention should not always be completely soluble in water under heating conditions and is not required to be made of a uniform composition which is soluble at a given temperature. Favorable influences may be obtained in most case where the fibers are made of composite materials having different solubilities and other physical properties.

It will be noted that the term "hot water-soluble fibers" is intended to mean those fibers which are sparingly soluble in water at normal temperatures and keep the shape of fibers and which start to be readily dissolved when heated on a dryer surface after formation of the sheet, whereupon when the sheet is immediately pressed by means of a device such as touch rolls, the fibers serve as a fibrous binder over the pulp fiber matrix. Subsequently, when the matrix is dehydrated and dried, it is solidified to give a high strength paper web whose fibers are not readily separated from one another unless placed in hot water.

A typical fibrous binder is a fibrous binder of PVA. In general, the PVA fibers are cut into short pieces, which are only swollen, but not soluble, in water at normal temperatures, and are dissolved in water at 60° to 90° C. or over and act as a binder.

Commercially available hot water-soluble PVA fibers are those whose dissolution-in-water temperatures are, respectively, 60° C., 70° C. and 80° C. The dissolution-in-water temperature means a temperature which is determined by subjecting a properly arranged fiber bundle to a load of 1/500 g/d at one end thereof, suspending it in water at normal temperatures, and raising the temperature of the water at a rate of about 2° C. per minute until the fibers are dissolved down.

The dissolution-in-water temperature almost corresponds to a temperature at which when the sheet is made, the binder fibers exhibit the adhesive capability after suffering the heat from dryer.

In the sheet according to the embodiments (1) and (2) of the invention, higher strength is obtained at a higher ratio of the hot water-soluble fibers, but the resultant sheet becomes harder and is not favorable in texture at too high a ratio. If the ratio is small, necessary strength cannot be obtained. Accordingly, a mixing ratio by weight of the hot water-soluble fibers to the mixture should preferably be in the range of 2% to approximately 30%. The polymer fibers having adhesion to pulp are, as stated above, polyvinyl alcohol fibers wherein the dissolution temperature can be controlled by controlling the degrees of polymerization and crosslinkage.

The crosslinked pulp used in the present invention is produced by dispersing pulp in a medium such as water and adding to the dispersion a crosslinking agent having, in the molecule, two or more functional groups capable of reaction with cellulose. The pulp crosslinked by the reaction has the intramolecular and intermolecular crosslinkage of the cellulose, so that the pulp is fixed as curled with high bulkiness and good dimensional stability. However, if the crosslinked points are too close to one another or if the crosslinking density is too high, the pulp becomes so weak in impact strength that when the pulp is again converted into fibers or re-fibrillated after the crosslinking reaction, the resultant fibers become too short and cannot stand practical use. On the contrary, when the distance between the crosslinkable functional groups is too long, bulky pulp is hardly obtained if the agent is used in large amounts.

The crosslinking agent should have such a chemical structure that at least two atoms are present between the functional groups and should have groups capable of reaction with the hydroxyl group of cellulose, e.g. methylol, alkoxymethyl, aldehyde, isocyanate, epoxy, vinyl and the like.

The halogen-containing compounds such as epichlorohydrin can be used for effective crosslinkage by the use of an alkali such as caustic soda.

Preferably, the agent should have a cyclic structure between the crosslinkable functional groups. Especially, the compound having an N-methylol group as the crosslinkable functional group is preferable because of its high reactivity. N-alkoxymethyl compounds which have been alkoxylated in order to stabilize the compounds or/and control the reactivity are also preferred. Specific examples are those having the following structural formulae:

Dimethylolethyleneurea

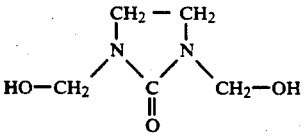

Dimethyloldihyroxyethyleneurea

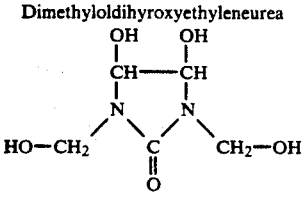

Dimethylolpropyleneurea

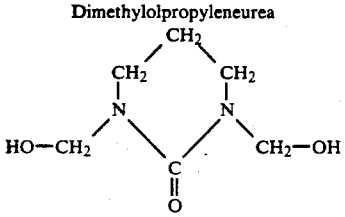

4-Methoxy-5,5'-dimethyl-N,N'-dimethylolpropyleneurea

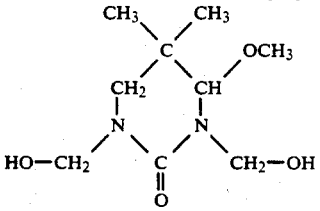

Dimethyloluron

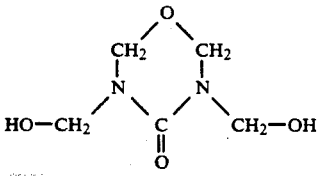

Dimethylolalkyl triazone

R = alkyl

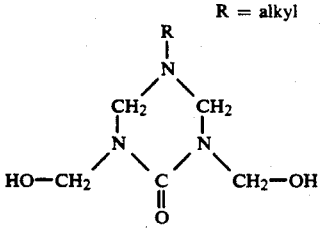

(Tetra, tri and di) methylolacetylenediurea

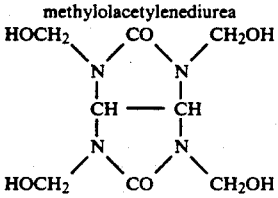

Dimethylolpiperadine

-continued

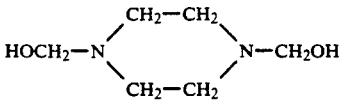

(Tri and di) methyloisocyanurate

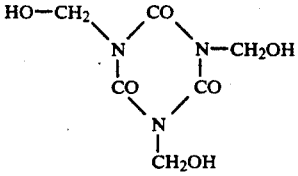

(Tetra, tri and di) methylolmelamine

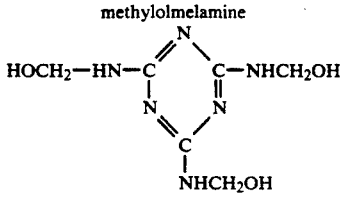

(Tetra, tri and di) methylolguanamine

R = alkyl or aryl

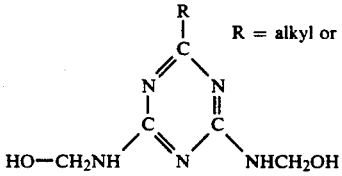

In order to impart various functions, these compounds may be reacted for modification with compounds capable of reaction with the methylol group.

Moreover, the reactive polymers such as methylol-modified polyacrylamide may be used for the crosslinkage.

The amount of the crosslinking agent used for the reaction is not less than 2 wt % based on the pulp and should preferably be less than 50 wt %. If the amount is too large although depending on the type of crosslinking agent, the bulkiness increases but the strength is lowered since re-conversion into fibers results in short fibers as stated before.

In an ordinary procedure wherein a crosslinking agent is applied using water as a solvent or liquid medium, dried, and heated for crosslinkage, followed by breakage or conversion into fibers, short fibers are liable to form. Accordingly, a procedure wherein when the crosslinked pulp is converted or broken into fibers, shearing force exerted on the pulp is reduced is preferred.

The formation of short fibers can be prevented by treating the pulp in a non-aqueous solvent or a solvent system containing water in amounts as small as possible, drying and converting into fibers. The content of water in the treating solution should preferably be not larger than 40%. A fibrillation aid such as a surface active agent is effective for this purpose.

The ordinary method of producing the crosslinked pulp comprises contacting with pulp a solution containing a crosslinking agent, a catalyst and, optionally, an aid, squeezing the pulp so that a predetermined amount of the crosslinking agent is deposited, drying, and subjecting to crosslinking reaction under heating conditions. After completion of the reaction, the pulp is broken into fibers, if necessary, filtered and dried.

The thus obtained crosslinked pulp is dispersed in water, after which paper is directly made or the fibers are collected or heaped up to give a sheet or mat. By the above procedure, the crosslinked pulp which is very bulky can be made. The crosslinked pulp has an apparent thickness of 8 to 12 times that of non-treated pulp under load-free conditions. Depending on the treating conditions, the bulkiness may reach 12 to 14 times greater.

The crosslinked pulp obtained by the above procedure is subjected to paper-making or collection by an ordinary method along with hot water-soluble fiber chops and hot pressed in wet state to obtain a sheet or mat.

Although depending on the pressure of the hot pressing, the sheet or mat of the invention can be readily controlled to have a degree of bulkiness of not less than 3 times that of a sheet or mat using non-crosslinked pulp and has thus a good texture.

In order to further improve or change the properties of the sheet or mat, a variety of additives may be used. The thickness of the sheet may be varied depending on the type and amount of additive. Examples of the additives include improvers for heat resistance, weatherability, water resistance, flame resistance, softness and strength, for which any known improvers may be used to show the improvements of the respective properties.

In the practice of the invention, the crosslinked pulp may be mixed with ordinary pulp with or without undergoing various chemical treatments. The hot water-soluble fibers may be used by mixing fibers of a plurality of materials. In addition, composite fibers containing a hot water-soluble polymer and having other functions may be used for polyfunctionality.

The bulky processed sheets according to the embodiments (3) to (7) of the invention stated before are those sheets which are obtained by mixing crosslinked pulp, thermally fusible fibers and a binder. The sheet may be embossed under heating conditions to obtain an embossed sheet.

The crosslinked pulp used for this purpose is produced by reaction of a crosslinking agent with pulp in a manner as stated before.

The crosslinked pulp used in the embodiments (3) to (7) of the invention has a crosslinked structure which has been formed by reaction of a crosslinking agent with hydroxyl groups in cellulose. Unlike ordinary pulp fibers, the bond between the pulp fibers caused by hydrogen bond or the degree of entangling of the fibers is reduced. The sheet obtained by a mere sheet making procedure has very low strength. This is the reason why a binder is necessary.

Examples of the binder include water-dispersable or soluble binders such as starch, polyvinyl alcohol and the like dissolved in water, polyvinyl alcohol powder dispersed in water, and emulsion latices of adhesive polymers such as SBR rubbers, NBR rubbers, natural rubber, acrylic and vinyl acetate polymers or copolymers, modified polymers thereof with carboxyl, hydroxyl, amino, epoxy and the like groups, and fibrous binders such as polyvinyl alcohol.

The fibrous binder should preferably be hot water-soluble fibers. The hot water-soluble fibers mean those fibers which are sparingly soluble in water at normal temperatures and keep the shape of fibers and which start to be readily dissolved when heated on a dryer surface after formation of the sheet, whereupon when the sheet is immediately pressed by means of a device such as touch rolls, the fibers serve as a fibrous binder over the pulp fiber matrix. Subsequently, when the matrix is dehydrated and dried, it is solidified to give a high strength paper web whose fibers are not readily separated from one another unless placed in hot water.

A typical fibrous binder is a fibrous binder of PVA. In general, the PVA fibers are cut into short pieces, which are only swollen, but not soluble, in water at normal temperatures, and are dissolved in water at 6° to 90° C. or over and act as a binder.

Commercially available hot water-soluble PVA fibers are those whose dissolution-in-water temperatures are, respectively, 60° C., 70° C. and 80° C. The dissolution-in-water temperature means a temperature which is determined by subjecting a properly arranged fiber bundle to a load of 1/500 g/d at one end thereof, suspending it in water at normal temperatures, and raising the temperature of the water at a rate of about 2° C. per minute until the fibers are dissolved down.

As described before, the dissolution-in-water temperature almost corresponds to a temperature at which when the sheet is made, the binder fibers exhibit the adhesive capability after suffering the heat from dryer.

The hot water-soluble fibers mixed with the crosslinked pulp and the thermally fusible fibers are formed into a sheet by a paper-making technique and heated in wet state at a slight pressure. Under these conditions, the hot water-soluble fibers act as an adhesive, thereby giving a sheet having very high strength.

The hot water-soluble fibers should not always be completely soluble in water under heating conditions and is not required to be made of a uniform composition which is soluble at a given temperature. Favorable influences may be obtained in most case where the fibers are made of composite materials having different solubilities and other physical properties.

In the sheet of the invention, higher strength is obtained at a higher ratio of the hot water-soluble fibers, but the resultant sheet becomes harder and is not favorable in texture at too high a ratio. If the ratio is small, necessary strength cannot be obtained. Accordingly, a mixing ratio by weight of the hot water-soluble fibers to the mixture should preferably be in the range of 1% to approximately 30%.

The fibers of polymers which have a softening point in water of not lower than 50° C. and are able to adhere to pulp are, as stated before, polyvinyl alcohol fibers whose dissolution temperature can be controlled by controlling the degrees of polymerization and crosslinkage.

The thermally fusible fibers used in the embodiments (3) to (7) and (11) to (15) of the invention are fibers of thermoplastic polymers which have a softening point of not higher than 150° C. and, in some case, not higher than 100° C. and are able to melt by heating and adhere to pulp, so that hot pressing readily permits heat sealing or embossing operations.

Examples of such fibers include ethylene-vinyl acetate copolymer fibers, polyester fibers, polyamide fibers. Preferably, fibrillated polyethylene low melting synthetic pulp which has been developed for paper-making purposes is used.

More preferably, composite thermally fusible fibers which are made of two or more polymers having different melting points are employed.

When the composite thermally fusible fibers are formulated, the embossing process of the sheet of the invention is effected such that the heating temperature should be set at a level which is lower than the softening point of a higher melting polymer in the fibers but is higher than the softening point of a lower melting polymer.

By thus, the fibers of the lower melting polymer are melted at the time of the heating so that the composite thermally fusible fibers are bonded together and embossed. The fibers of the higher melting polymer are not deformed and contribute to keep the strength of the sheet. The portions which have not been heated at the time of the embossing are left as bulky, thereby obtaining a cellulose-based bulky sheet of the invention which has excellent bulkiness and is decoratively, strongly embossed.

If the ratio of the composite thermally fusible fibers in the sheet of the invention is small, the embossing does not proceed satisfactorily with a lowering in strength of the embossed sheet. On the contrary, when the ratio is high, the merits of the bulky pulp will be lost.

Accordingly, the mixing ratio by weight of the composite thermally fusible fibers should be in the range of from 5% to approximately 50%. If the thermally fusible fibers are used in large amounts within the above range, the moisture absorption characteristic and texture can be appropriately controlled.

If the melting point of a lower melting polymer in the composite thermally fusible fibers is higher, the embossing temperature should accordingly be high, causing the pulp fibers to deteriorate. A lower melting point is more favorable and should be not higher than 200° C., preferably from 180° C. to 80° C.

The composite thermally fusible fibers which are made of combinations of two or more polymers having different melting points include a number of fibers which depend on the types of polymers being combined and the manner of preparation of the fibers and all these fibers may be used in the embodiments (3) to (7) and (11) to (15) of the invention.

A typical example includes composite fibers of polypropylene/polyethylene (commercial name: Chisso Polypro ES fibers) wherein the melting points of lower melting ingredients are all not higher than 135° C. and some have a melting point of not higher than 100° C. and are preferred for such purposes.

Aside from the above fibers, fibers of polyesters/low melting polyesters, polyesters/low melting polyethylene, polypropylene/low melting ethylene-vinyl acetate copolymers, nylon 66/nylon 6, nylon 6/polyethylene, polyesters/nylon 6 may be likewise used.

The crosslinked pulp used in these embodiments are those described hereinbefore.

There may be used in combination not only pulp fibers, but also one or more of synthetic fibers of rayon, vinylon, polyesters, acryl resins, aramide resins, polyolefins and the like, and inorganic fibers or chops of alumina, ceramics, metals, glass, carbon and the like, thereby imparting inherent properties of the respective fibers.

The cellulose-based, inflammable, bulky processed sheets according to the embodiments (8) to (15) of the invention may be imparted with inflammability according to the following three procedures.

In the first procedure, the sheet obtained from crosslinked pulp and hot water-soluble fibers is treated with a solution or/and dispersion of a flame retardant.

In the second procedure, a flame retardant which is insoluble in water is added at the time of the sheet-making procedure and deposited.

In the third procedure, the bulky pulp is subjected to flame retardancy and is mixed with hot water-soluble fibers for making a sheet.

The flame retardants useful in the first procedure are water-soluble flame retardants which are effective for cellulosic materials. Such retardants should have flameproofness and include ammonium salts, amine salts, guanidine salts and carbamine salts of organic and inorganic acids. Examples of the acids include phosphoric acid, polyphosphoric acid, sulfuric acid, sulfamic acid, imidosulfonic acid and the like.

Among these flame retardants, N compounds having active hydrogen which are reacted with formaldehyde to form a methylol group in order to increase solubility in water may also be used effectively. These flame retardants are used after dissolution in water and may be dispersed in water by using an excessive amount thereof exceeding the solubility. In the latter case, a slurry having a uniform dispersion of the retardant is used for treatment of the materials therewith to deposit the retardant thereon, thereby imparting flame retardance.

It will be noted that the above retardants are water-soluble salts, with an attendant problem that the resultant sheet is difficult for sizing and the flame retardance will be lowered by washing with water. To avoid this, the treatment with a solution or dispersion of a water-insoluble flame retardant in water or a solvent other than water may be used for imparting flame retardance.

Examples of such water-insoluble flame retardants include alkyl esters of phosphoric acid, aryl esters of phosphoric acid, alkyl aryl esters of phosphoric acid, halogenated phosphoric esters and the like. Although the halogenated phosphoric esters are effective, they are not favorable in view of the presence of the halogen.

In the second flame-retardant procedure, use of water-insoluble flame retardants is preferred although sparingly soluble retardants may be used. As a matter of course, flame retardants which are soluble or sparingly soluble in water may be used after insolubilization by surface treatment or capsulation.

Examples of such flame retardants include polycondensation ammonium polyphosphate, guanidine polyphosphate, co-condensation products of condensable compounds such as ammonium phosphate and urea, or phosphoric acid urea and melamine or dicyandiamide. Among them, sparingly soluble compounds are used after insolubilization by capsulation.

Although zinc borate, antimony oxide, boric acid, borax, aluminum hydroxide and magnesium hydroxide may be likewise used, larger amounts are required and they are not most preferable.

In the third flame retardancy procedure, reactive flame retardants are used. These retardants are reacted with cellulose fibers or reacted with other compounds to entangle with cellulose fibers for flame retardancy. Examples of the flame retardants include tetrakisphosphonium salts, N-methyloldimethylphosphonopropionamide (vinyl phosphonate oligomer available from Stauffer Inc.)

The reactive flame retardant may be used to treat the sheet obtained from crosslinked pulp and hot water-soluble fibers as in the first procedure, with a continuing effect of the flame retardancy.

The flame retardancy may be realized by combining two or more of the first, second and third procedures.

The crosslinked pulp used in these embodiments is one which is produced by reaction of pulp with crosslinking agents as described before. The hot water-soluble fibers used in the invention should have a softening point in water of not lower than 50° C. and should contain a polymer having adhesion to pulp.

As described before, the crosslinked pulp used in the invention has such a crosslinked structure that a crosslinking agent is reacted with hydroxyl groups of cellulose, and has thus a lower degree of bond between cellulose fibers owing to the hydrogen bond than ordinary pulp, with a considerable lowering of the strength as compared with the pulp which has not been crosslinked. In the practice of the invention, hot water-soluble fibers are mixed with the pulp, which is subsequently hot pressed in wet condition, so that the hot water-soluble fibers serve as an adhesive for the pulp, thereby obtaining a sheet having very high strength.

The embossing may be effected either by a one-stage procedure of producing a bulky sheet or by a two-stage procedure wherein after production of a bulky sheet, it is embossed in wet state.

The hot water-soluble fibers used in these embodiments of the invention should not always be completely soluble in water under heating conditions and is not required to be made of a uniform composition which is soluble at a given temperature. Favorable influences may be obtained in most case where the fibers are made of composite materials having different solubilities and other physical properties.

In the sheet according to the embodiments (8) and (15) of the invention, higher strength is obtained at a higher ratio of the hot water-soluble fibers, but the resultant sheet becomes harder and is not favorable in texture at too high a ratio. On the contrary, if the ratio is small, necessary strength cannot be obtained. Accordingly, a mixing ratio by weight of the hot water-soluble fibers to the mixture should preferably be in the range of 2% to approximately 30%. The polymer fibers having adhesion to pulp are, as stated above, polyvinyl alcohol fibers wherein the dissolution temperature can be controlled by controlling the degrees of polymerization and crosslinkage.

The fibers of a polymer having adhesion to pulp include polyvinyl alcohol fibers, whose dissolution temperature can be appropriately controlled by controlling the degrees of polymerization and crosslinkage.

The crosslinked pulp used in the embodiments (11) to (15) has such a crosslinked structure that a crosslinking agent is reacted with the hydroxyl groups of cellulose, and has thus a lower degree of bond between cellulose fibers owing to the hydrogen bond than ordinary pulp, with a considerable lowering of the strength as compared with the pulp which has not been crosslinked. Accordingly, a binder is necessary in these embodiments of the invention.

The binder used may be one which has been stated with respect to the embodiments (3) to (7).

According to the invention, there can be obtained processed sheets which are made of pulp and have very high bulkiness, high strength, good dimensional stability and good texture. These sheets can be utilized in various fields making use of the features of cellulose. When printed or embossed, these sheets become very decorative and have highly unique utility.

Moreover, the present invention also provides a sheet which is made of pulp and is high in flame retardancy and bulkiness with good strength, dimensional stability and texture and which has the humidity controlling function necessary for interior materials and particularly, a wall paper. In addition, the sheet has high safety with respect to the emission of smoke and the generation of gases at the time of burning. When printed or embossed, the sheet can be utilized as a highly decorative embossed wall paper and can also be very favorably used as an interior material for vehicles or ships.

The present invention is described by way of examples.

EXAMPLES 1, 2 AND COMPARATIVE EXAMPLES 1, 2

Coniferous wood pulp was broken into fibers in the following treating solution by the use of a small-size mixer.

| Treating solution composition: | |
|---|---|
| Dimethyloldihydroxyethyleneurea | 5 parts by weight |
| Zinc nitrate | 1 part by weight |
| Water | 94 parts by weight |

After the breakage into fibers, the suspension was subjected to suction filtration by means of a glass funnel and dried at 100° C. for 1 hour, followed by reaction while heating at 120° C. for 20 minutes. Thereafter, the resultant product was again broken into fibers, and subjected to filtration by suction with use of a glass funnel under slight compression, thereby obtaining a circular sheet sample. This sample was dried at 100° C. for 2 hours while keeping the shape, thereby obtaining a bulky crosslinked pulp.

The increase in weight of the pulp was 9.5% based on the starting pulp and the thickness measured under load-free conditions was 10.6 times that of a sheet which had been treated in the same manner as described above without use of any crosslinking agent.

Fabrication of Bulky Processed Sheets

The crosslinked pulp obtained above and polyvinyl alcohol (PVA) fibers (VP 105-2 available from Kuraray Co., Ltd.) were mixed and dispersed in water, followed by sheet making by means of the TAPPI standard sheet machine. The sheet was dried by passing through a drum dryer at a surface temperature of 110° C. for 3 minutes to obtain a bulky sheet. The basis weight ($g/m^2$) and thickness of this sheet were measured along with a breaking length determined by a tensile test according to JIS P 8113.

Column-shaped copper wires having a width of 2.0 mm and a height of 6.0 mm were set side by side on the sheet in which about 50% of moisture was contained, followed by hot pressing at 120° C. for 5 minutes to obtain an embossed sheet sample for measurement of the breaking length.

The test pieces for the measurement were those which were obtained by placing the wires so that two lines per 15 mm in width were longitudinally embossed. The formulations and the results of the measurements are shown in Table 1.

For comparison, pulp which was not crosslinked was used to make sheets for the measurements. The results are shown in the table as Comparative Examples.

The bulky sheets were also subjected to measurement of moisture absorption by allowing them to stand in a humidistat chamber set at 25° C. at a humidity of 92% (in the presence of an ammonium mono-phosphate saturated aqueous solution). The results are shown in Table 1.

EXAMPLES 3, 4

The general procedure of Example 1 was repeated using the following composition of a solution for the crosslinking treatment, thereby obtaining a bulky crosslinked pulp.

| | |
|---|---|
| Dimethyloldihydroxyethyleneurea | 8 parts by weight |
| Zinc nitrate | 2 parts by weight |
| Water | 90 parts by weight |

The increase in weight was 14.2% based on the starting pulp. The thickness measured under load-free conditions was 11.2 times that of a sheet obtained in the same manner as described above without use of any crosslinking agent.

In the same manner as in Example 1, the bulky sheets and embossed sheets were made, followed by measurement of the basis weight, thickness and strength. The results are shown in Table 1.

EXAMPLES 5, 6

In the same manner as in Example 1 using tetramethylolacetylenediurea as the crosslinking agent and the following composition, a bulky crosslinked pulp was obtained.

| | |
|---|---|
| Tetramethylolacetylenediurea | 4 parts by weight |
| Zinc nitrate | 1 part by weight |
| Water | 95 parts by weight |

The increase in weight of the crosslinked pulp was 7.6% based on the starting pulp and the thickness measured under load-free conditions was 10.2 times that of a sheet obtained in the same manner as described above without use of any crosslinking agent. In the same manner as in Example 1, the bulky sheets and embossed sheets were made and subjected to measurements of the basis weight, thickness and strength. The formulations and results are shown in Table 1.

| Treating solution composition: | |
|---|---|
| Dimethyloldihydroxyethyleneurea | 5 parts by weight |
| Zinc nitrate | 1 part by weight |
| Water | 94 parts by weight |

After the breakage into fibers, the suspension was subjected to suction filtration by means of a glass funnel and dried at 100° C. for 1 hour, followed by reaction while heating at 120° C. for 20 minutes. Thereafter, the resultant product was again broken into fibers, and subjected to filtration by suction with use of a glass funnel under slight compression, thereby obtaining a circular sheet sample. This sample was dried at 100° C. for 2 hours while keeping the shape, thereby obtaining a bulky crosslinked pulp.

The increase in weight of the pulp was 9.5% based on the starting pulp and the thickness measured under load-free conditions was 10.5 times that of a sheet which had been treated in the same manner as described above without use of any crosslinking agent.

Fabrication of Bulky Processed Sheets

The crosslinked pulp obtained above, polyvinyl alcohol (PVA) fibers (VP 105-2 available from Kuraray Co., Ltd.) and polypropylene/polyethylene composite fibers (Chisso Polypro Fibers EA available from Tisso Co., Ltd.) were mixed and dispersed in water, followed by sheet making by means of the TAPPI standard sheet machine.

The resultant wet sheet was dried by passing through a drum dryer at a surface temperature of 110° C. for 3 minutes to obtain a bulky sheet. The basis weight ($g/m^2$) and thickness of this sheet were measured along with a breaking length determined by a tensile test according to JIS P 8113.

Column-shaped copper wires having a width of 2.0 mm and a height of 6.0 mm were set side by side on the sheet, followed by hot pressing at 120° C. for 5 minutes to obtain an embossed sheet sample for measurement of the breaking length.

The test pieces for the measurement were those which were obtained by placing the wires so that two lines per 15 mm in width were longitudinally formed.

The formulations and the results of the measurements are shown in Table 2.

TABLE 1

| | Ex. 1 | Comp. Ex. 1 | Ex. 2 | Comp. Ex. 2 | Ex. 3 | Ex. 4 | Ex. 5 | Ex. 6 |
|---|---|---|---|---|---|---|---|---|
| Formulation | | | | | | | | |
| crosslinked pulp (parts) | 90 | | 80 | | 90 | 80 | 90 | 95 |
| non-crosslinked pulp (parts) | | 90 | | 80 | | | | |
| PVA fibers (parts) | 10 | 10 | 20 | 20 | 10 | 20 | 10 | 5 |
| Formed Sheet | | | | | | | | |
| basis weight ($g/m^2$) | 195 | 191 | 186 | 191 | 191 | 194 | 198 | 195 |
| thickness (mm) | 1.38 | 0.44 | 1.37 | 0.39 | 1.46 | 1.28 | 1.27 | 1.34 |
| breaking length (Km) | 1.04 | 3.51 | 1.50 | 3.32 | 0.92 | 1.26 | 1.34 | 1.13 |
| breaking length of embossed sheet (Km) | 1.44 | — | 1.75 | — | 1.15 | 1.44 | 1.40 | 1.21 |
| Moisture Absorption (increment by %) | | | | | | | | |
| after 2 hours | 4.1 | 4.5 | 3.9 | 4.6 | | | | |
| after 6 hours | 5.5 | 6.3 | 5.9 | 6.4 | | | | |
| after 24 hours | 8.0 | 8.4 | 8.5 | 8.3 | | | | |
| after 72 hours | 8.7 | 9.1 | 8.7 | 8.9 | | | | |

EXAMPLES 7, 8 AND COMPARATIVE EXAMPLES 3, 4

Coniferous wood pulp was broken into fibers in the following treating solution by the use of a small-size mixer for experiment.

For comparison, pulp which was not crosslinked was used to make sheets and test pieces undergoing the hot pressing for the measurements.

The bulky sheets were also subjected to measurement of moisture absorption by allowing them to stand in a humidistat chamber set at 25° C. at a humidity of 92% (in the presence of an ammonium mono-phosphate saturated aqueous solution). The results are shown in Table 2.

EXAMPLES 9, 10 AND 11

The general procedure of Example 7 was repeated using the following composition of a solution for the crosslinking treatment, thereby obtaining a bulky crosslinked pulp.

| | |
|---|---|
| Dimethyloldihydroxyethyleneurea | 8 parts by weight |
| Zinc nitrate | 2 parts by weight |
| Water | 90 parts by weight |

The increase in weight was 14.2% based on the starting pulp. The thickness measured under load-free conditions was 11.2 times that of a sheet obtained in the same manner as described above without use of any crosslinking agent.

In the same manner as in Example 1, the bulky sheets and embossed sheets were made, followed by measurement of the basis weight, thickness and strength. The results are shown in Table 2.

EXAMPLE 12

In the same manner as in Example 7 using tetramethylolacetylenediurea as the crosslinking agent and the following composition, a bulky crosslinked pulp was obtained.

| | |
|---|---|
| Tetramethylolacetylenediurea | 4 parts by weight |
| Zinc nitrate | 1 part by weight |
| Water | 95 parts by weight |

The increase in weight of the crosslinked pulp was 7.6% based on the starting pulp and the thickness measured under load-free conditions was 10.2 times that of a sheet obtained in the same manner as described above without use of any crosslinking agent. In the same manner as in Example 7, the bulky sheets and embossed sheets were made and subjected to measurements of the basis weight, thickness and strength. The formulations and results are shown in Table 2.

As will be apparent from the Table 2, the sheets of these examples using the crosslinked pulp, PVA fibers and EA fibers have a thickness (bulkiness) of 3 to 4 times greater than that of the sheets of the comparative examples using non-crosslinked pulp instead of the crosslinked pulp, and the breaking length is only a fraction of those for comparison. On the other hand, the moisture absorption of the sheets according to the invention is slightly poorer than that for comparison and is at a level enough for wall paper.

TABLE 2

| | Ex. 7 | Comp. Ex. 3 | Ex. 8 | Comp. Ex. 4 | Ex. 9 | Ex. 10 | Ex. 11 | Ex. 12 |
|---|---|---|---|---|---|---|---|---|
| Formulation | | | | | | | | |
| crosslinked pulp | 75 | — | 70 | — | 70 | 65 | 65 | 75 |
| non-crosslinked pulp | — | 75 | — | 70 | — | — | — | — |
| PVA fibers | 5 | 5 | 10 | 10 | 5 | 15 | 20 | 5 |
| EA fibers | 20 | 20 | 20 | 20 | 25 | 20 | 15 | 20 |
| Formed Sheet | | | | | | | | |
| basis weight (g/m$^2$) | 207 | 184 | 206 | 189 | 197 | 196 | 191 | 203 |
| thickness (mm) | 1.66 | 0.44 | 1.49 | 0.46 | 1.74 | 1.63 | 1.78 | 1.57 |
| breaking length (Km) | 0.77 | 5.00 | 1.36 | 4.58 | 0.55 | 0.93 | 1.13 | 0.78 |
| breaking length of embossed sheet (Km) | 1.08 | — | 1.52 | — | 0.82 | 1.17 | 1.24 | 1.10 |
| Moisture Absorption (increment by %) | | | | | | | | |
| after 2 hours | 3.0 | 4.4 | 3.6 | 3.7 | | | | |
| after 6 hours | 4.2 | 5.3 | 4.5 | 5.2 | | | | |
| after 24 hours | 5.8 | 6.8 | 6.1 | 6.6 | | | | |
| after 72 hours | 6.7 | 7.7 | 6.9 | 7.5 | | | | |

EXAMPLE 13 AND COMPARATIVE EXAMPLE 5

Coniferous wood pulp was broken into fibers in the following treating solution by the use of a domestic mixer.

| Treating solution composition: | |
|---|---|
| Dimethyloldihydroxyethyleneurea | 8 parts by weight |
| Zinc nitrate | 2 part by weight |
| Water | 90 parts by weight |

After the breakage into fibers, the suspension was subjected to suction filtration by means of a glass funnel and dried at 100° C. for 1 hour, followed by curing at 120° C. for 30 minutes. Thereafter, the resultant product was again broken into fibers, and subjected to filtration by suction with use of a glass funnel under slight compression, thereby obtaining a circular sheet sample. This sample was dried at 100° C. for 2 hours while keeping the shape, thereby obtaining a bulky crosslinked pulp. The increase in weight of the pulp was 14.2% based on the starting pulp and the thickness measured under load-free conditions was 11.2 times that of a sheet which had been treated in the same manner as described above without use of any crosslinking agent.

Fabrication of inflammable Bulky Processed Sheets

The crosslinked pulp obtained above, polyvinyl alcohol (PVA) fibers (VP 105-2 available from Kuraray Co., Ltd.) and insoluble ammonium polyphosphate were mixed and dispersed in water along with a small amount of polyethylene imine, followed by sheet making by means of the TAPPI standard sheet machine.

The drying was effected by passing the sheet through a drum dryer at a surface temperature of 110° C. for 3 minutes to obtain an inflammable bulky sheet.

The basis weight (g/m$^2$) and thickness of this sheet were measured along with a breaking length determined by a tensile test according to JIS P 8113.

Moreover, column-shaped copper wires having a width of 2.0 mm and a height of 6.0 mm were set side by side on the sheet in which about 50% of moisture was contained, followed by hot pressing at 120° C. for 5 minutes to obtain an embossed sheet sample for measurement of the breaking length.

The test pieces for the measurement were those which were obtained by placing the wires so that two lines per 15 mm in width were longitudinally formed.

The formulations and the results of the measurements are shown in Table 3.

For comparison, pulp which was not crosslinked was used to make a sheet for the measurements as shown in Table 3 as Comparative Example.

The inflammable bulky sheets were also subjected to measurement of moisture absorption by allowing them to stand in a humidistat chamber set at 25° C. at a humidity of 92% (in the presence of an ammonium phosphate saturated aqueous solution). The results are shown in Table 3.

The inflammability test was conducted by measuring a char length according to the method prescribed in JIS Z-2150 "Fireproofing Test For Thin Materials" (Meckel Burner method) for a flame contacting time of 10 seconds. The results are shown in Table 3.

EXAMPLE 14 AND COMPARATIVE EXAMPLE 6

The crosslinked pulp prepared in Example 13 and PVA fibers (VP 105-2 available from Kuraray Co., Ltd.) were mixed and dispersed in water, subjected to sheet-making by the TAPPI standard sheet machine and dried with a drum dryer, after which the sheet was impregnated with a 20% guanidine sulfamate aqueous solution and squeezed with rolls. Thereafter, the sheet was dried in the same manner as in Example 13 to obtain an inflammable bulky sheet. The increase in weight was 24%.

This sheet was subjected to measurements of the basis weight, thickness, strength, water absorption and inflammability in the same manner as in Example 13. Moreover, an embossed sheet was made in the same manner as in Example 13 and subjected to measurement of strength. The formulation and the results of the measurements are shown in Table 3.

For comparison, the above procedure was repeated without use of any crosslinking agent. The results of the measurement are shown in Table 3.

EXAMPLES 15, 16

In the same manner as in Example 13 using a treating solution for the crosslinking treatment having the following composition:

| | |
|---|---|
| dimethyloldihydoxyethyleneurea | 10 parts by weight |
| zinc nitrate | 2 parts by weight |
| water | 88 parts by weight |

there was obtained a bulky pulp. The increase in weight was 19.4% based on the starting pulp, and the thickness measured under load-free conditions was 13.1 times that obtained in the same manner as described above without use of any crosslinking agent.

In the same manner as in Example 13, inflammable sheets and embossed sheets were made, followed by measurements of the basis weight, thickness, strength and flameproofness. The formulations and the results of the measurements are shown in Table 3.

EXAMPLE 17

In the same manner as in Example 13 using the following composition comprising tetramethylolacetylenediurea as the crosslinking agent, there was obtained a bulky crosslinked pulp

| | |
|---|---|
| tetramethylolacetylenediurea | 4 parts by weight |
| zinc nitrate | 1 part by weight |
| water | 95 parts by weight |

The increase in weight was 7.6% based on the starting pulp, and the thickness measured under load-free conditions was 10.2 times that obtained in the same manner as described above without use of any crosslinking agent. In the same manner as in Example 13, an inflammable sheet and an embossed sheet were made, followed by measurements of the basis weight, thickness, strength and flameproofness. The formulations and the results of the measurements are shown in Table 3.

TABLE 3

| | Ex. 13 | Comp. Ex. 5 | Ex. 14 | Comp. Ex. 6 | Ex. 15 | Ex. 16 | Ex. 17 |
|---|---|---|---|---|---|---|---|
| Formulation | | | | | | | |
| crosslinked pulp | 70 | — | 70 | — | 75 | 68 | 83 |
| non-crosslinked pulp | — | 70 | — | 70 | — | — | — |
| PVA fibers | 10 | 10 | 10 | 10 | 5 | 10 | 5 |
| ammonium polyphosphate | 20 | 20 | — | — | 15 | — | 12 |
| guanidine sulfamate | | | 20 | 20 | — | 22 | — |
| Formed Sheet | | | | | | | |
| basis weight (g/m$^2$) | 182 | 186 | 191 | 196 | 194 | 207 | 196 |
| thickness (mm) | 1.37 | 0.41 | 1.28 | 0.36 | 1.48 | 1.46 | 1.36 |
| breaking length (Km) | 0.81 | 4.14 | 0.72 | 3.25 | 0.97 | 0.88 | 0.58 |
| breaking length of embossed sheet (Km) | 1.22 | — | 1.02 | — | 1.24 | 1.13 | 0.75 |
| char length (cm) | 7.7 | 7.5 | 8.1 | 7.8 | 8.7 | 7.8 | 9.0 |
| Moisture Absorption (increasement by %) | | | | | | | |
| after 2 hours | 3.2 | 4.0 | 8.1 | 8.7 | | | |
| after 6 hours | 4.8 | 5.6 | 10.1 | 10.4 | | | |
| after 24 hours | 6.5 | 7.3 | 11.4 | 13.8 | | | |

TABLE 3-continued

| | Ex. 13 | Comp. Ex. 5 | Ex. 14 | Comp. Ex. 6 | Ex. 15 | Ex. 16 | Ex. 17 |
|---|---|---|---|---|---|---|---|
| after 72 hours | 7.2 | 7.8 | 13.0 | 15.4 | | | |

EXAMPLE 18 AND COMPARATIVE EXAMPLE 7

Coniferous wood pulp was broken into fibers in the following treating solution by the use of a small-size mixer.

| Treating solution composition: | |
|---|---|
| Dimethyloldihydroxyethyleneurea | 8 parts by weight |
| Zinc nitrate | 2 parts by weight |
| Water | 90 parts by weight |

After the breakage into fibers, the suspension was subjected to suction filtration by means of a glass funnel and dried at 100° C. for 1 hour, followed by curing while heating at 120° C. for 30 minutes. Thereafter, the resultant product was again broken into fibers, and subjected to filtration by suction with use of a glass funnel under slight compression, thereby obtaining a circular sheet sample. This sample was dried at 100° C. for 2 hours while keeping the shape, thereby obtaining a bulky crosslinked pulp. The increase in weight of the pulp was 14.2% based on the starting pulp and the thickness measured under load-free conditions was 11.2 times that of a sheet which had been treated in the same manner as described above without use of any crosslinking agent.

The crosslinked pulp obtained above, polyvinyl alcohol (PVA) fibers (VP 105-2 available from Kuraray Co., Ltd.), polypropylene/polyethylene composite fibers (Chisso Polypro Fibers EA available from Chisso Co., Ltd.) and insoluble ammonium polyphosphate were mixed and dispersed in water along with a small amount of polyethylene imine, followed by sheet making by means of the TAPPI standard sheet machine.

The resultant sheet was dried by passing through a drum dryer at a surface temperature of 110° C. for 3 minutes to obtain an inflammable bulky processed sheet. The basis weight (g/m$^2$) and thickness of this sheet were measured along with a breaking length determined by a tensile test according to JIS P 8113.

Column-shaped copper wires having a width of 2.0 mm and a height of 6.0 mm were set side by side on the sheet, followed by hot pressing at 120° C. for 5 minutes to obtain an embossed sheet sample for measurement of the breaking length. The test pieces for the measurement were those which were obtained by placing the wires so that two lines per 15 mm in width were longitudinally formed.

The formulations and the results of the measurements are shown in Table 4.

For comparison, pulp which was not crosslinked was used to make sheets for the measurements with the results shown in the table.

The inflammable bulky sheets were also subjected to measurement of moisture absorption by allowing them to stand in a humidistat chamber set at 25° C. at a humidity of 92% (in the presence of an ammonium phosphate saturated aqueous solution). The results are shown in Table 4.

The inflammability test was conducted by measuring a char length according to the method prescribed in JIS Z-2150 "Fireproofing Test For Thin Materials" (Meckel Burner method at 45° C.) for a flame contacting time of 10 seconds. The results are shown in Table 4.

EXAMPLE 19 AND COMPARATIVE EXAMPLE 8

The crosslinked pulp obtained in Example 18, polyvinyl alcohol (PVA) fibers (VP 105-2 available from Kuraray Co., Ltd.), and polypropylene/polyethylene composite fibers (Chisso Polypro Fibers EA) were mixed and dispersed in water, followed by sheet making by means of the TAPPI standard sheet machine. After drying with a drum dryer, the sheet was immersed in a 20% guanidine sulfamate aqueous solution and squeezed with rolls, followed by drying in the same manner as in Example 18 to obtain an inflammable bulky sheet. The increase in weight after the treatment with the guanidine sulfamate was 25%.

In the same manner as in Example 18, the sheet was subjected to measurements of the basis weight, thickness, strength, moisture absorption and inflammability. Moreover, an embossed sheet was similarly fabricated and its strength was measured. The results are shown in Table 4.

On the other hand, pulp which was not treated without use of any crosslinking agent was used to make sheets for Comparative Example 8. The results of measurements are shown in Table 4.

EXAMPLES 20, 21

In the same manner as in Example 18 using a treating solution for the crosslinking treatment having the following composition:

| | |
|---|---|
| dimethyloldihydoxyethyleneurea | 10 parts by weight |
| zinc nitrate | 2 parts by weight |
| water | 88 parts by weight |

there was obtained a bulky pulp. The increase in weight was 19.4% based on the starting pulp, and the thickness measured under load-free conditions was 13.1 times that obtained in the same manner as described above without use of any crosslinking agent.

In the same manner as in Example 18, inflammable bulky sheets and embossed sheets were made, followed by measurements of the basis weight, thickness and strength. The results for the respective formulations are shown in Table 4.

EXAMPLE 22

In the same manner as in Example 18 using tetramethylolacetylenediurea as the crosslinking agent and the following composition, there was obtained a bulky crosslinked pulp.

| | |
|---|---|
| Tetramethylolacetylenediurea | 4 parts by weight |
| Zinc nitrate | 1 part by weight |
| Water | 95 parts by weight |

The increase in weight was 7.6% based on the starting pulp, and the thickness measured under load-free conditions was 10.2 times that obtained in the same manner as described above without use of any crosslinking agent.

In the same manner as in Example 18, inflammable bulky sheets and embossed sheets were made, followed by measurements of the basis weight, thickness, strength and inflammability. The formulations and the results are shown in Table 4.

TABLE 4

| | Ex. 18 | Comp. Ex. 7 | Ex. 19 | Comp. Ex. 8 | Ex. 20 | Ex. 21 | Ex. 22 |
|---|---|---|---|---|---|---|---|
| Formulation | | | | | | | |
| crosslinked pulp | 55 | — | 54 | — | 60 | 50 | 60 |
| non-crosslinked pulp | — | 55 | — | 54 | — | — | — |
| PVA fibers | 5 | 5 | 5 | 5 | 5 | 10 | 7 |
| EA fibers | 20 | 20 | 20 | 20 | 20 | 20 | 18 |
| ammonium polyphosphate | 20 | 20 | | | 15 | — | 15 |
| guanidine sulfamate | | | 21 | 21 | — | 20 | — |
| Formed Sheet | | | | | | | |
| basis weight (g/m$^2$) | 184 | 190 | 196 | 194 | 192 | 205 | 194 |
| thickness (mm) | 1.39 | 0.45 | 1.32 | 0.42 | 1.30 | 1.40 | 1.25 |
| breaking length (Km) | 0.70 | 2.74 | 0.66 | 1.77 | 0.98 | 0.82 | 1.28 |
| breaking length of embossed sheet (Km) | 1.04 | — | 0.97 | — | 1.29 | 1.33 | 1.38 |
| char length (cm) | 7.9 | 7.6 | 8.2 | 7.8 | 8.5 | 8.4 | 8.8 |
| Moisture Absorption (increment by %) | | | | | | | |
| after 2 hours | 3.0 | 3.6 | 6.2 | 7.1 | | | |
| after 6 hours | 4.1 | 4.7 | 7.4 | 8.9 | | | |
| after 24 hours | 6.2 | 6.8 | 10.7 | 12.1 | | | |
| after 72 hours | 6.6 | 7.2 | 11.2 | 13.5 | | | |

What is claimed is:

1. A method for making a bulky processed sheet or mat which method consists essentially of the steps of
   (a) producing a crosslinked cellulose pulp by treating a cellulose pulp with 2–50% by weight, based on the weight of the cellulose pulp, of a crosslinking agent,
   (b) breaking up the crosslinked cellulose pulp into a bulky mass of smaller crosslinked cellulose fibers, this bulky mass having a thickness measured under load-free conditions which was 8–14 times greater than that of a sheet which had been treated in the same manner as described above but without the use of a crosslinking agent,
   (c) mixing the bulky mass of smaller crosslinked cellulose fibers with 1–50% by weight of a fibrous binder selected from the group consisting of (1) fibers that are soluble in hot water and (2 ) thermally fusible fibers,
   (d) forming the mixture resulting from step (c) into a bulky sheet and subjecting the sheet in a wet state to a hot pressing treatment,
   (e) drying said hot pressed sheet, and
   (f) embossing the dried sheet under heating conditions.

2. A method according to claim 1 wherein said embossing is effected at a temperature lower than the softening point of said thermally fusible fibers.

3. A method according to claim 1 wherein the crosslinking agent has a cyclic structure between the crosslinkable functional group.

4. A method according to claim 1 wherein the crosslinking agent is selected from the group consisting of dimethylolethyleneurea, dimethyloldihyroxyethyleneurea, dimethylolpropyleneurea, 4-methoxy-5-5'-dimethyl-N,N'-dimethylolpropyleneurea, dimethyloluron, dimethylolalkyl triazone, (tetra, tri and di) methylolacetylenediurea, dimethylolpiperadine, (tri and di) methyloisocyanurate, (tetra, tri and di) methylolmelamine, (tetra, tri and di) methylolguanamine.

5. A method according to claim 1 wherein the crosslinking agent is dimethylolidhyroxyethyleneurea.

6. A method according to claim 1 wherein the crosslinking agent is tetramethylolacetylenediurea.

7. A method according to claim 1 wherein the fibrous binder is a fiber that is soluble in water.

8. A method according to claim 1 wherein the fibrous binder is a thermally fusible fiber.

9. A process according to claim 1 wherein the thermally fusible fibers are thermally fusible composite fibers obtained by subjecting two or more thermoplastic polymers having different melting points to composite melt spinning.

10. A bulky process sheet produced according to the method of claim 1.

11. A bulky process sheet produced according to the method of claim 2.

12. A bulky process sheet produced according to the method of claim 3.

13. A bulky process sheet produced according to the method of claim 4.

14. A bulky process sheet produced according to the method of claim 5.

15. A bulky process sheet produced according to the method of claim 6.

16. A bulky process sheet produced according to the method of claim 7.

17. A bulky process sheet produced according to the method of claim 8.

18. A bulky process sheet produced according to the method of claim 9.

* * * * *